United States Patent [19]

Bramley et al.

[11] 4,330,980

[45] May 25, 1982

[54] APPARATUS AND METHOD FOR INSERTING STRIPS OF MICROFILM INTO MICROFILM JACKETS

[75] Inventors: Richard G. Bramley, Winnetka; Thomas P. Anderson, Jr., Northbrook, both of Ill.

[73] Assignee: Microseal Corporation, Zion, Ill.

[21] Appl. No.: 141,627

[22] Filed: Apr. 18, 1980

[51] Int. Cl.[3] ..... B65B 5/10

[52] U.S. Cl. ..... 53/473; 53/475; 53/246; 53/390

[58] Field of Search ..... 53/473, 475, 469, 459, 53/236, 246, 390, 257, 435, 520

[56] References Cited

U.S. PATENT DOCUMENTS

| | | | |
|---|---|---|---|
| 2,937,483 | 5/1960 | Engelstein | 53/520 |
| 3,141,275 | 7/1964 | Anderson et al. | 53/520 |
| 3,141,276 | 7/1964 | Anderson et al. | 53/520 |
| 3,238,655 | 3/1966 | Engelstein | 53/520 |
| 3,314,213 | 4/1967 | Peppler | 53/246 X |
| 3,429,101 | 2/1969 | Anderson et al. | 53/520 X |
| 3,872,645 | 3/1975 | Dorman | 53/520 |
| 3,965,556 | 6/1976 | Sanchez et al. | 53/520 X |
| 4,064,677 | 12/1977 | Takahashi et al. | 53/520 |
| 4,099,362 | 7/1978 | Dorman | 53/520 |
| 4,102,029 | 7/1978 | Thompson | 53/435 X |

*Primary Examiner*—Horace M. Culver

*Attorney, Agent, or Firm*—Hill, Van Santen, Steadman, Chiara & Simpson

[57] ABSTRACT

Automatic machinery, particularly suited for the loading of pre-cut, individual microfilm strips into the storage channels of microfilm jackets, includes a feed roll shaft intermediate of insertion chute means and a loading pedestal carrying the jacket. Respective feed rolls overlie corresponding delivery ends of chutes and the jacket edges leading to channel openings. A film strip is first inserted into a chute and is in registry with the jacket edge. Then, the pedestal is raised upward to press the film between the lower surface of the corresponding feed roll and the jacket edge, whereupon the feed roll is activated to drive the strip into the channel.

17 Claims, 7 Drawing Figures

FIG 4
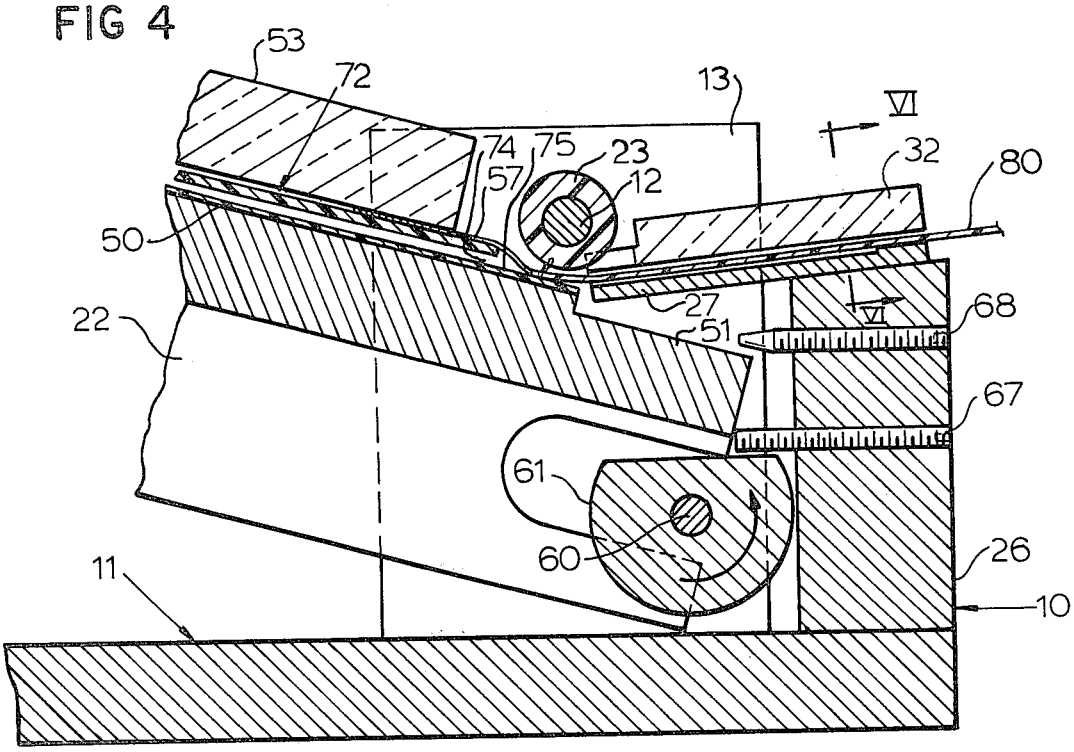
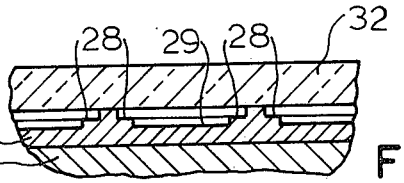
FIG 6
FIG 5
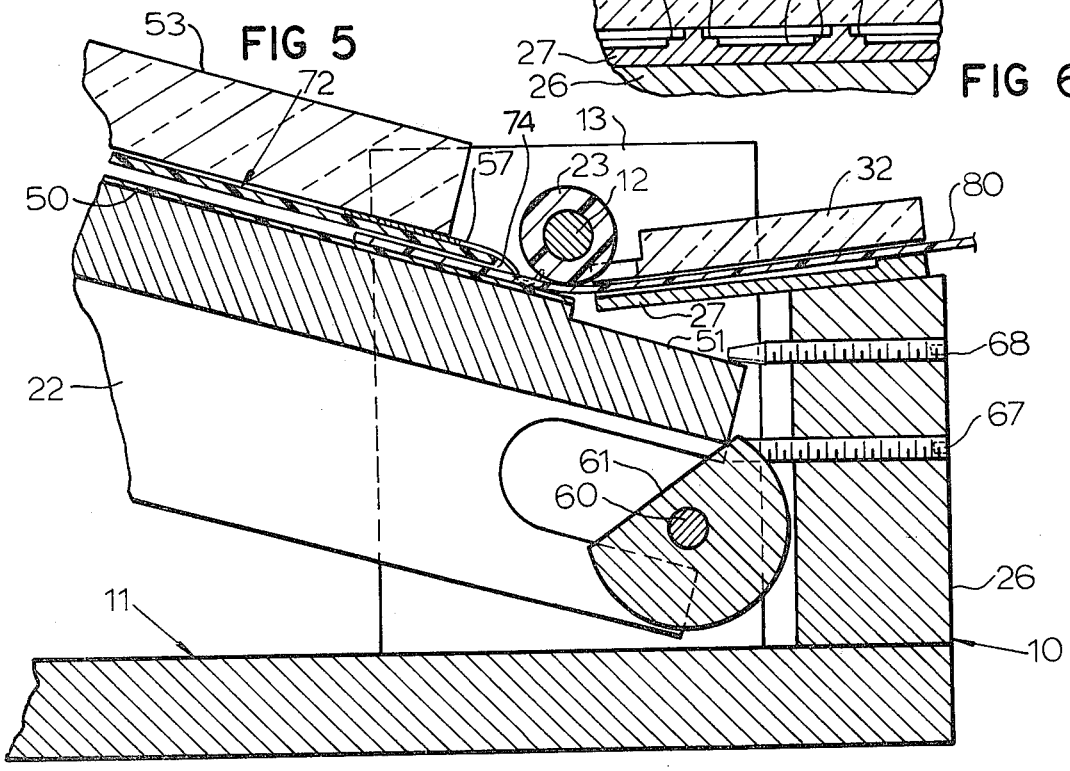

APPARATUS AND METHOD FOR INSERTING STRIPS OF MICROFILM INTO MICROFILM JACKETS

BACKGROUND OF THE INVENTION

1. Field of the Invention

This invention is directed to the loading of microfilm strips into microfilm jackets and, more particularly, to a method and apparatus for automatic insertion of one or more strips into jacket pockets.

2. The Prior Art

Microfilm jackets are now in wide use in the microfilm industry. These jackets generally comprise a pair of transparent plastic sheets formed with a plurality of film channels or pockets. Parallel bonding ribs define the channels and sandwich the sheets together. The side edges of the top sheet are notched or cut back to designate openings through which film is inserted within the pockets. The jackets may be stored in files and carry the microfilm images for scanning or copying and enlarging by photographic or other processes. The jackets lend themselves particularily effectively to contact printing in the production of reference copies.

For a long time, microfilm strips have been sectioned from rolls and then inserted into the channels of the jacket by automatic machinery. In recent years, a new technique develops microfilm images onto individual 6 inch (or 152.4 mm) strips. The film roll loaders presently in use do not lend themselves to insertion of the individual strips into the jackets; hence, the 6 inch strips have had to be manually passed into jacket pockets.

U.S. Pat. No. 2,937,483 to Engelstein is exemplary of a type of film roll-loader equipment in use today. In that equipment, microfilm web is unrolled from a roll and threaded along a horizontal track beneath a feed roller. Downstream of the track, the jacket is supported on an inclined plate. The channel openings are positioned just off the edge of the track and coplanar with the track. Between the feed roller and the end of the track is a film slicer. In operation, the film is transported by the feed roller into registry with the underlying edge of the jacket just below the channel opening. The web, being flexible, tends to curl downward when unrolled; but, since the jacket is inclined and the film is confined by the track, the web is deflected upwardly into the channel. When the film is driven fully into the channel, the slicer is activated to shear the film.

In these film roll loaders, placement of the feed roller along the track is not critical. Succeeding film is unwound to propel the web segment to be loaded. However, once the trail edge of a 6-inch strip is passed beneath a feed roller, movement of the strip stops, leaving the strip unloaded if a film roll loader were used. An upward curl of the ends of the pre-cut, individual strips often occurs. Film roll-loader machinery is ineffective to pass upturned film edges into channel openings since an edge would tend to register with the jacket above the channel opening.

The present invention is directed to the design of an automatic jacket-loading machine for the insertion of pre-cut, individual microfilm strips into jacket pockets.

SUMMARY OF THE INVENTION

A jacket-loading machine for handling microfilm strips, constructed in accordance with the principles of the present invention, has a rotary shaft which extends transversely across a generally rectangular base inparallel with opposed sides of the base and is supported for rotation above the base. The shaft contains a series of spaced-apart feed rolls and is positioned adjacent one side of the base so as to define a narrow space and a wide space on opposed sides of the shaft. Within the narrow space is mounted a row of chutes leading to corresponding feed rolls. Within the wide space is provided a replaceable pedestal, downwardly inclined toward the shaft. The pedestal is mounted for sliding movement relative to the shaft and vertical movement adjacent its inner end which underlies leading edges of the chutes. The upper surface of the pedestal is formed with a platform to which a microfilm jacket is attached with channel openings facing corresponding feed rolls. The jacket extends to the inner edge of the platform such that, when the pedestal is positioned for loading, the bottom sheet portions of the jacket leading to the channel openings underlie the rolls. A pivotal cover overlies the platform to secure the jacket and is provided with spring clip fingers which extend between the feed rolls and serve to hold leading edges of the jacket flat against the platform on either side of the channel openings. In loading operation, one or more microfilm strips, whether whole or segments, are inserted along the chutes to pass beneath corresponding feed rolls in registry with the bottom sheet portions of the jacket. The inner end of the pedestal is then raised upward to press the film against the feed rolls by depressing the on/off lever, which simultaneously activates the motor driven feed rollers to drive the multiple strips fully into the jacket channels.

BRIEF DESCRIPTION OF THE DRAWINGS

FIG. 4 is an enlarged cross-sectional view taken along the lines IV—IV of FIG. 2 showing use of the machine with a jacket having cut back channel openings and strip insertion along a chute.

FIG. 5 is an enlarged cross-sectional view corresponding to FIG. 4 showing loading of a strip into a jacket channel.

FIG. 6 is an enlarged, partial cross-sectional view of an empty chute taken along lines VI—VI of FIG. 4.

DESCRIPTION OF THE PREFERRED EMBODIMENT

Figure 1:
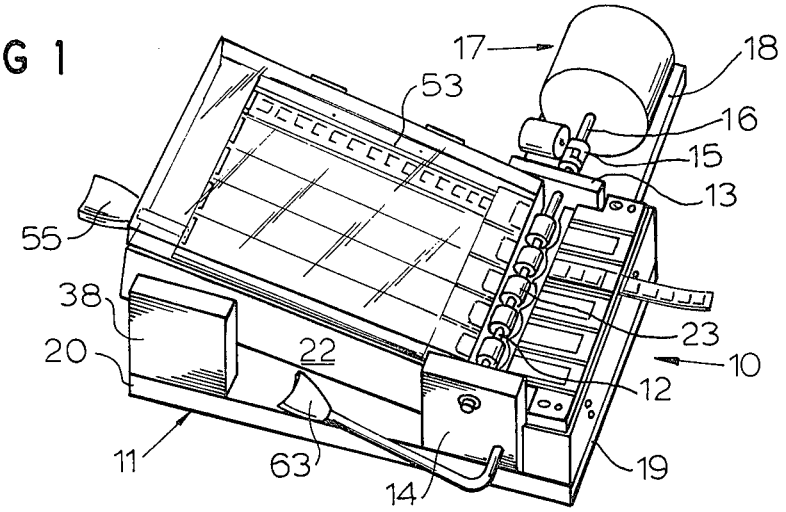
FIG. 1 is a perspective view of an automatic machine for inserting microfilm strips in accordance with the present invention.

In FIG. 1, there is shown a machine 10, constructed in accordance with the principles of the present invention, for the automatic loading of precut microfilm strips into respective channels of microfilm jackets. The apparatus includes a generally rectangular base member 11 for standing the machine on a flat surface, such as a desk or table top. A rotary shaft 12 extends transversely over the base, supported at upper and lower edges of the base in wall members 13 and 14, respectively. Journals (not shown) within these wall members permit rotation of the shaft 12. The shaft extends through the upper wall member 13 and terminates in a connector piece 15, which joins the shaft 12 with the output 16 of a rotary electric motor means 17. The motor is mounted on plate 18, equiplanar with the base member 11. The electric motor drive is preferably in a range of 50–100 r.p.m. for the particular embodiment shown in FIG. 1. Extending inward from the right side 19 of the base is a strip chute means 21. The chute means serve to guide microfilm strips into the machine 10 for loading. Extending inward from the left side 20 of the base is a pedestal or platen 22 for carrying the microfilm jacket. Both the pedestal and chute means are inclined downward toward the shaft 12 and terminate at edges underlying the shaft.

That portion of the shaft 12 between upper and lower walls 13 and 14 has a series of symmetrically spaced-apart feed rolls 23 formed therealong. The feed rolls are of a radius slightly greater than the shaft 12. Feed rolls of an OD of less than 0.5 inch have been found to be preferable for closer tolerances in relative positioning on the machine. The rolls, preferably, have an outer diameter surface of polyurethane, such as polyurethane 55 compound. Polyeurothane has been found to have been a particularily effective gripping surface against microfilm strips, which are generally formed of a clear plastic material such as acetate or polyester.

Figure 2:
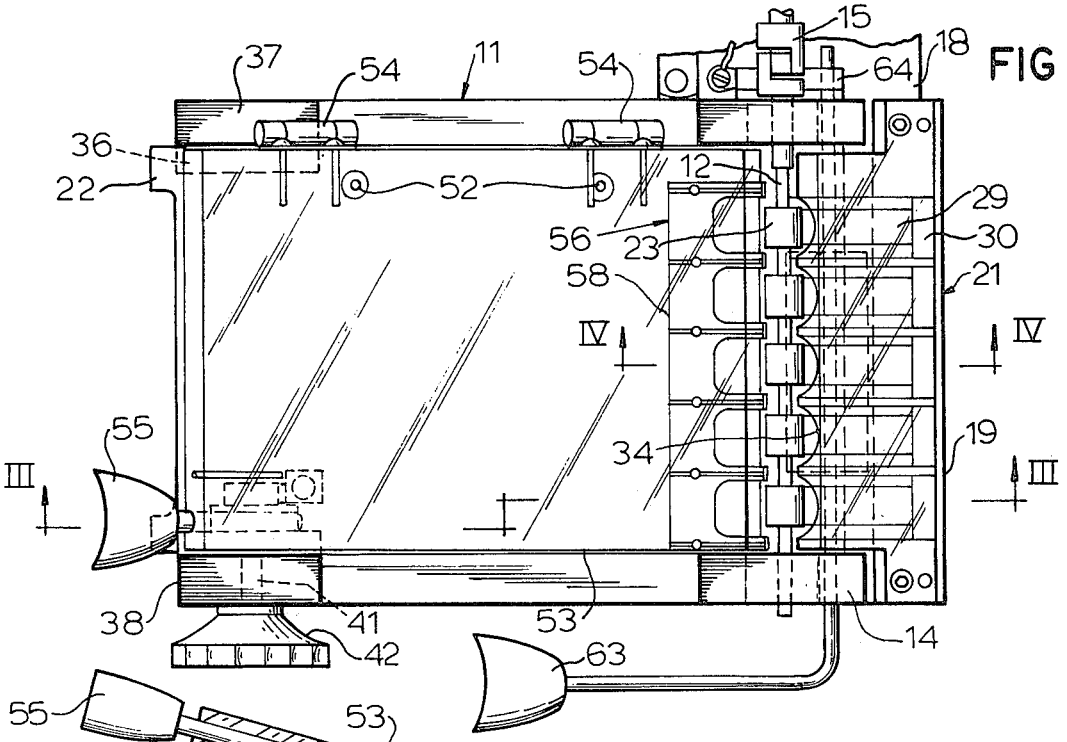
FIG. 2 is a partial plan view of the machine shown in FIG. 1.
Figure 3:
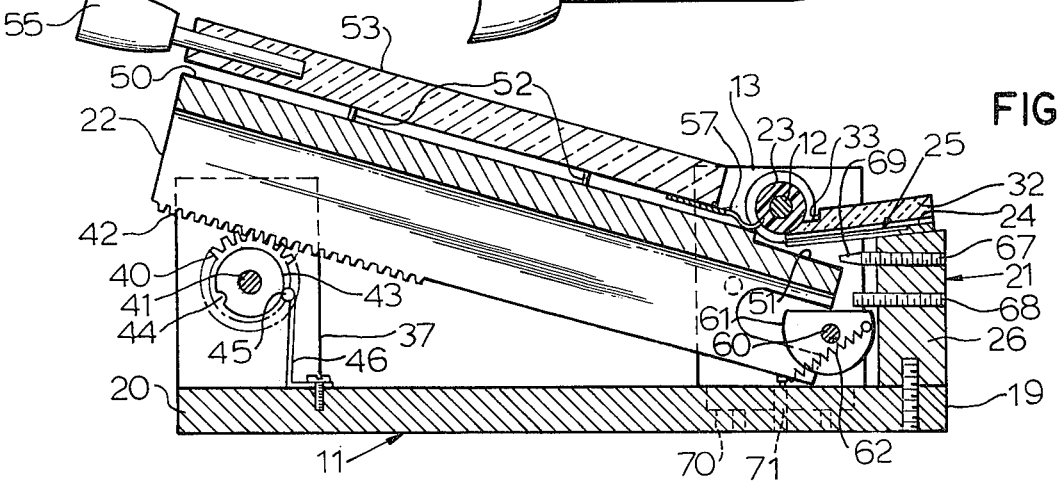
FIG. 3 is a cross-sectional view taken along the lines III—III of FIG. 2.

With reference to FIGS. 1–3, the axis of the shaft 12 extends across the base 11 in parallel with the left and right sides, 20 and 19, respectively, of the base and along a line nearer the right side 19. Mounted on the base, within the more narrow space to the right of the shaft 12, is the chute means 21. The chute means comprises a plate member 24 having formed therealong a row of symmetrically spaced film chutes 25 by which microfilm strips are inserted for loading into the machine 10. The plate member 24 is fitted onto the inclined upper surface of a mounting wall 26 secured to the base. All of the chutes slant downward (preferably at about 4°) from the right base side 19 and are aligned with corresponding feed rolls 23. The delivery ends 27 of the chutes terminate beneath the feed rolls and are spaced therefrom a distance slightly more than the thickness of a microfilm strip.

The chute members are preferably of polished stainless steel for smooth passage of film thereover. In order to reduce the risk of scratching a film strip across recorded images as the strip is conveyed along a chute, guide surfaces 28 are formed only along side edges of each chute as shown in FIG. 6. The chute floor 29 between these guide edges 28 is recessed away from the path of the film. Preferably, the recessed floor 29 extends from the delivery edge 27 of each chute to a point spaced a slight distance downstream from the opening edge of the chute. The opening floor 30 is of an even height across the width of each chute to ensure proper alignment of a microfilm strip upon insertion into the chute. Fitted over the chute plate 24 and coextensive therewith is a dust cover 32, preferably of a clear plastic material such as Lexan. The inner leading edge of the cover 32 is stepped at 33 and formed with concave-shaped recesses 34 for receiving the feed rolls, enabling the cover 32 to fit closely adjacent to the rolls.

The pedestal 22, positioned over the base to the left of the shaft 12, is a generally rectangular platen which is slidable in the machine 10 and removable therefrom. The lower surface of the pedestal is formed with runner surfaces at upper and lower ends for corresponding sliding movement along slanted guides 36 extending inward from upper and lower mounting walls, 37 and 38, respectively. The mounting walls are fixedly secured on the base 11. The guides 36 are inclined downward (preferably at about 15°) toward the shaft 12 and spaced apart from one another across the base. The pedestal 22, at its lower right-hand edge rests on the upper surface of the base 11. Preferably, the pedestal is made of aluminum; and the base and mounting walls 37 and 38 are formed of polished stainless steel to facilitate sliding contact with the pedestal.

The pedestal 22 is linearly movable toward and away from the shaft 12 under the control of a pinion 40, which is supported for rotation on a shaft 41 mounted for rotation in the lower wall 38. A line of rack teeth 42 is formed along the undersurface of the pedestal 22 corresponding engagement with the pinion. The pinion may be manually rotated by means of a hand knob 42 fitted at an end of the pinion shaft 41 extending outward from the wall 38. Further fitted on the pinion shaft 41 is a detent wheel 43, located inward of the pinion. The wheel 43 has a generally smooth outer diameter except for a detent recess 44 which cooperates with a pin 45 to hesitate movement of the pedestal away from the feed rolls for attaching and removing jackets therefrom. The pin 45 is made to ride over the circumferential surface of the wheel 43 at the end of a resilient metal arm 46 pin connected in the base.

Figure 7:
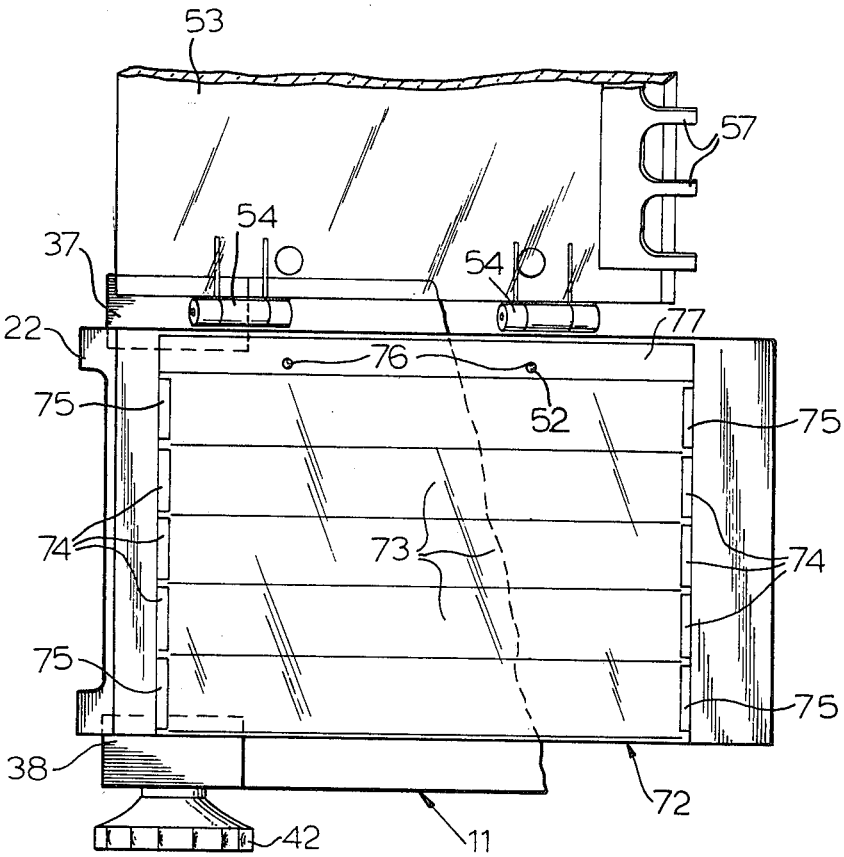
FIG. 7 is a partial plan view corresponding to FIG. 2 showing a jacket having cut back channel openings positioned on the pedestal of the machine shown in FIG. 1.

The upper surface of the pedestal 22 is formed with a flat platform 50 upraised from a lower side edge step portion 51 extending along the inner edge of the pedestal. A pair of pins 52 are positioned along the upper end of the platform to fit through corresponding holes in a microfilm jacket so as to properly locate the jacket on the platform. A cover plate 53 overlies the platform to secure the jacket by sheer weight. The cover plate is mounted for pivotal movement on pin means 54 to permit exposure of the platform for attachment or removal of a jacket as shown in FIG. 7. A handle 55 is fixed in the plate for manual movement of the plate. Preferably, the cover plate 53 is of transparent plastic material, such as Lexan, to permit operator viewing of the jacket loading operation.

A spring clip element 56 is fastened against the undersurface of the cover plate 53 adjacent the right-hand edge thereof. The spring clip is formed with metallic, resilient fingers 57 extending outward from a panel member 58. The fingers are spaced-apart to interfit between the feed rolls 23 and serve to hold jacket edges on either side of the pocket openings flat against the platform so that no portion of the jacket interferes with passage of film strips into channels.

Adjacent the mounting wall 26 and underlying the chutes 25 is mounted a rotary shaft 60 journaled between the wall members 13 and 14. Fitted on the shaft is a cam 61 which, upon rotation of the shaft, engages with the right-hand leading edge of the pedestal to raise that end of the pedestal 22 toward the feed rolls 23. The cam 61 is biased by a spring means 62 away from the edge of the pedestal. The cam shaft 60 may be operated manually by means of a handle 63 formed at one end of the shaft extending outward from the wall 14. The other end of the shaft 60 extends through wall 13 and is fitted with a lever arm means 64 which overlies the motor mounting plate 19. The lever arm serves to trigger an on/off switch (not shown) to the motor 17. In this manner, the motor is activated simultaneous with raising of the pedestal.

Positioning elements are provided for proper adjustment of the pedestal 22 in the machine 10 such that a film strip registers effectively on the jacket. Upper and lower screw stop means, 67 and 68, respectively, extend inward through the mounting wall 26 for registry with the pedestal. The upper screw stop 67 has a tapered end 69 for engagement with the pedestal leading edge. Adjustment of the screw 67 stops lift of the pedestal 22 for proper tensioning of film against the feed rolls during loading. Adjustment of the screw 68 serves as a linear stop to placement of the pedestal. As shown in FIG. 3, the machine 10 may include a plate member 70, fitted in the upper surface of the base 11, which is vertically adjustable along a screw shaft 71. The plate 70 also serves to selectively raise the right-hand edge of the pedestal 22 for proper alignment of the jacket channels.

Figure 8:
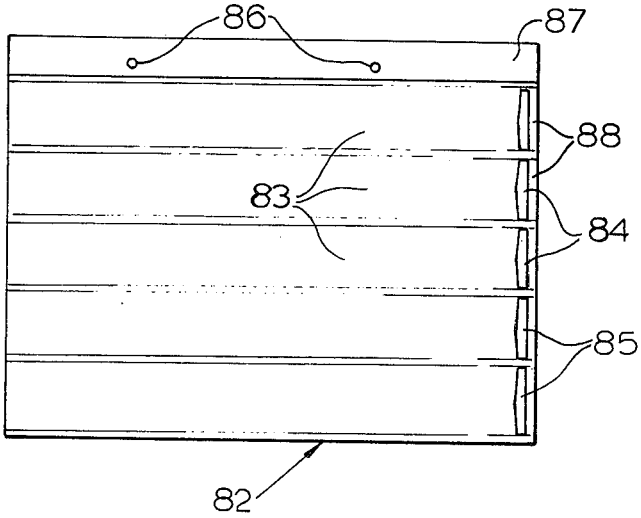
FIG. 8 is a plan view of another type of microfilm jacket having notched channel openings which may also be loaded with the automatic machine shown in FIG. 1.

The instant machine 10 has been found to be particularily effective in loading strips into a microfilm jacket of a type shown in FIG. 7 at 72. Jacket 72 has channels 73, each with openings 74 at either end of the channel. The channel openings are spaced inward slightly, or cut back, from side edges of the jacket, so as to effectively eliminate microfilm scratches often caused from scaping the microfilm over raised die cut edges 88 of a conventional jacket such as shown in FIG. 8 at 82. Underlying lip or sheet edge portions 75 lead into the channel openings. The jacket 72 is formed with pin holes 76 along an upper rib portion 77 for securement onto a pedestal platform 50 such that the side edges of the jacket are coextensive with the side edges of the platform underlying the feed rolls in the machine 10. The jacket construction 72 is disclosed in copending U.S. patent application Ser. No. 141,647, filed Apr. 18, 1980, on behalf of Richard G. Bramley and Thomas P. Anderson, Sr., and which is commonly assigned herewith.

In operation, FIG. 4 shows positioning of the various elements prior to the automatic loading of the jacket 72. A pre-cut microfilm strip 80 is initially inserted within a chute 25. The underlying leading edge portion 75 is supported on the pedestal platform 50, spaced beneath the corresponding feed roll 23 a distance slightly greater than the thickness of the film 80. The channel opening 74 is spaced further along the incline of the pedestal 22 so as to be above the lower point of the feed roll. The delivery end 27 of the chute directs the initial edge of the film strip 80 into registry with the underlying leading edge portion 75 of the jacket. The film edge is deflected upwardly toward the channel opening 74. The cam 61 is in its at rest position at this point.

FIG. 5 illustrates machine loading of the strip 80 into the jacket channel 73. The cam shaft 60 is rotated counterclockwise, causing the lead edge of the pedestal to be upraised against stop screw surface 69 and triggering actuation of the feed roll motor 17. Lifting of the pedestal presses the film 80 into contact with the feed roll 23, such that the roll propels the film into the channel until the tail end of the strip is no longer in contact with the feed roll. Microfilm strips may be loaded one at a time or simultaneously in different jacket channels with the machine 10. The individual film strips may be whole or in segments.

The instant machine 10 is not limited to use with any particular microfilm jacket construction. FIG. 8 shows another well-known form of jacket useable with the present invention. This jacket 82 has channels 83, each with openings 84 notched within the upper jacket sheet at a distance away from the right side edge of the jacket. The notches form gaps which expose underlying sheet spaces 85 in front of the channel openings 84. Pin holes 86 formed in an upper rib portion 87 place the right side edges coextensive with the platform edge. The difference in operation arises in that now the lead edge of a film strip initially lies against the upper jacket sheet before automatic loading begins and that the spring fingers 57 become more necessary with this form of jacket.

The pedestal 22 may serve as a modular piece. If proper pin hole alignment for a different jacket cannot be arranged on one pedestal, another pedestal with a platform suited to the different jacket can be used in the machine 10.

Although various minor modifications may be suggested by those versed in the art, it should be understood that we wish to embody within the scope of the patent warranted hereon all such modifications as reasonably and properly come within the scope of our contribution to the art.

We claim as our invention:

1. A method of feeding pre-cut, individual microfilm strips into lateral channels of a microfilm jacket, each channel having a lip edge adjacent a lateral side of said jacket and an inwardly disposed channel opening adjacent said lip edge, comprising:

supporting said jacket on a platform such that said lip edges are adjacent a lateral side edge of said platform, directing at least one microfilm strip along a chute means having a lead edge facing said platform side edge such that a lead end of said strip abuts with the lip edge of one said channel, rotating a feed roll means about an axis parallel with said lead and side edges and disposed therebetween, and moving said platform side edge toward said feed roll means to bring said strip lead end into driving contact with said feed roll means and away from said feed roll means to permit said strip lead end to be initially disposed in engagement with said lip edge.

2. The method according to claim 1, further comprising:

securing a placement of said microfilm jacket on said platform to prevent curl in said lip edge of said microfilm jacket from interfering with the registry of the lead end of said at least one microfilm strip thereagainst.

3. The method according to claim 1, further comprising:

inserting a plurality of microfilm strips into said chute means for simultaneous loading of a corresponding plurality of channels.

4. A machine for feeding pre-cut, individual microfilm strips into lateral chambers of a microfilm jacket, each chamber having a lip edge adjacent a lateral side of said jacket and an inwardly displaced channel opening adjacent said lip edge, comprising:

a laterally inclined platform for supporting said jacket such that said lip edges are adjacent a lower side edge of said platform, a laterally inclined chute means having a lower lead edge facing said platform side edge for guiding at least one strip such that a lead end thereof engages the lip edge of one said chamber, and a feed roll means connected to drive means and mounted for driven rotation about an axis parallel with said lead and side edges and disposed therebetween, whereby said feed roll means contacts said at least one strip lead end and rotation thereof drives said at least one strip over said lip edge through said chamber opening and into the one said chamber.

5. The machine of claim 4, further comprising:

an adjustment means for raising and lowering said lower side edge of said platform for correspondingly bringing the lead end of said at least one strip into and out of driving engagement with said feed roll means.

6. The machine of claim 5, wherein said chute means comprises a plurality of side-by-side parallel chutes for guiding a plurality of strips such that lead ends thereof engage the associated lip edges of more than one chamber and said plurality of strips are simultaneously driven by said feed roll means.

7. The machine of claim 5, wherein said adjustment means comprises a rotatable camshaft means located beneath said lower side edge of said platform, said camshaft means having a cam for raising and lowering said lower side edge.

8. The machine of claim 5, further comprising switch means connected to said adjustment means for triggering driving rotation of said feed roll means when said platform side edge is raised.

9. The machine of claim 5, wherein said chute means comprises at least one chute having a laterally extending bottom surface intermediate opposed lateral side step portions, said bottom surface having a relatively recessed portion terminating at said lead edge and a relatively raised entry portion adjacent an edge laterally opposed from said lead edge.

10. The machine of claim 4, wherein said chute means comprises a plurality of side-by-side parallel chutes for guiding a plurality of strips such that lead ends thereof engage the associated lip edges of more than one chamber and said plurality of strips are simultaneously driven by said feed roll means.

11. An apparatus for feeding pre-cut, individual microfilm strips into lateral channels of a microfilm jacket, each channel having a lip edge adjacent a lateral side of said jacket and an inwardly disposed channel opening adjacent said lip edge, comprising:

a platform for supporting said jacket such that said lip edges are adjacent a lateral side edge of said platform, a chute means having a lateral lead edge facing said platform side edge for guiding at least one strip such that a lead end of said strip abuts with the lip edge of one said channel, a feed roll means connected to drive means and mounted for driven rotation about an axis parallel with said lead and side edges and disposed therebetween, and engagement means for bringing said lead end of said strip into driving contact with said feed roll means such that rotation of said feed roll means drives said strip over said lip edge through said channel opening and into the one said channel.

12. The apparatus of claim 11, wherein said chute means comprises a plurality of side-by-side parallel chutes for guiding a plurality of strips such that the lead ends thereof engage the associated lip edges of more than one channel and said feed roll means simultaneously drives said plurality of strips into said more than one channels.

13. The apparatus of claim 12, wherein said feed roll means comprises a plurality of individual rollers spaced apart along a shaft, each said roller having an outer diameter surface of polyurethane.

14. The apparatus of claim 11, wherein said engagement means comprises cam means for raising and lowering said side edge of said platform to corresponding bring said strip lead end into and out of driving contact with said feed roll means.

15. The apparatus of claim 14, wherein said engagement means further comprises switch means for triggering driving rotation of said feed roll means when said platform side edge is raised.

16. The apparatus of claim 11, wherein said chute means comprises at least one chute having a laterally extending bottom surface intermediate opposed lateral side step portions, said bottom surface having a relatively recessed portion terminating at said lead edge and a relatively raised entry portion adjacent an edge laterally opposed from said lead edge.

17. The apparatus of claim 11, further comprising means for adjustably positioning said platform such that said platform side edge is aligned with and suitably adjacent said chute means lead edge.

* * * * *